US005415330A

United States Patent [19]

Rosso

[11] Patent Number: 5,415,330

[45] Date of Patent: May 16, 1995

[54] FEEDER FOR GUIDING STOCKINGS IN LOOPING MACHINES

[75] Inventor: Pietro Rosso, Turin, Italy

[73] Assignee: Rosso Industrie S.P.A., Orbassano, Italy

[21] Appl. No.: 122,581

[22] PCT Filed: Jan. 29, 1993

[86] PCT No.: PCT/EP93/00206

§ 371 Date: Sep. 29, 1993

§ 102(e) Date: Sep. 29, 1993

[87] PCT Pub. No.: WO93/15252

PCT Pub. Date: Aug. 5, 1993

[30] Foreign Application Priority Data

Jan. 29, 1992 [IT] Italy ..... TO92U0018

[51] Int. Cl.[6] ..... D06C 5/00

[52] U.S. Cl. ..... 223/77; 223/75; 223/74; 223/1

[58] Field of Search ..... 223/1, 75, 77, 76, 63, 223/61, 52, 74; 112/25

[56] References Cited

U.S. PATENT DOCUMENTS

| | | | |
|---|---|---|---|
| 2,857,085 | 10/1958 | Bowman et al. | 223/1 |
| 3,026,007 | 3/1962 | Autem | 223/77 |
| 3,197,094 | 7/1965 | Fowler | 223/77 |
| 3,482,743 | 12/1969 | Saltiel | 223/1 |
| 3,731,642 | 5/1973 | Wittki et al. | 112/25 |

FOREIGN PATENT DOCUMENTS

| | | | |
|---|---|---|---|
| 2247101 | 7/1973 | France | 223/75 |
| 2616161 | 6/1987 | France | 223/75 |
| 3640486 | 2/1988 | Germany | 223/75 |
| 1203356 | 10/1968 | United Kingdom | 223/75 |

*Primary Examiner*—Clifford D. Crowder
*Assistant Examiner*—Bibhu Mohanty
*Attorney, Agent, or Firm*—Herbert Dubno; Yuri Kateshov

[57] ABSTRACT

A feeder for guiding stockings in a looping machine includes a mechanism for rapid adjustment of the opening width between two mutually facing guide bars provided with two horizontal mutually parallel rods loaded by respective springs pressing the rods against an actuating element mounted rotatably about a horizontal axis running perpendicular to the rods and provided with an angularly displaceable grip for displacing the rods and one of the guide bars connected fixedly therewith toward and away from the other guide bar.

5 Claims, 7 Drawing Sheets

IV
IV
1
2
3
4
5
7
10
11
12
15
16
21
22
23
24
25
26
27
29
31
33

FEEDER FOR GUIDING STOCKINGS IN LOOPING MACHINES

CROSS REFERENCE TO RELATED APPLICATIONS

This application is a national phase application of PCT/EP 93/00206 filed Jan. 29, 1993, and based in turn, upon an Italian application TO 92 U 000 filed Jan. 29, 1992, under the International Convention.

FIELD OF THE INVENTION The invention relates to a feeder for guiding stockings in a looping machine with a mechanism for rapid adjustment of the opening width two bars facing one another.

BACKGROUND OF THE INVENTION

Feeders with the two bars for guiding the stockings arranged underneath a support bracket mounted in turn, on vertical wall of the looping machine are already known. In order to adjust the distance between the two bars to the respective type of hosiery, the "inner bar" is stationary while the "outer bar" can be displaced horizontally. In known feeders this adjustment takes place due to the fact that the inner bar is fastened to the support bracket with screws, while the outer bar is fastened to two support elements attached to the support bracket and are spaced apart in the longitudinal direction of the bar. Pressure springs act against the adjustable bar, whereby the bar can be moved away, or brought close to the vertical wall by actuating elements. The outer bar is thereby fastened by two screws to the lower end of pertaining bushings provided with inner threading and inserted in vertical bores, which are provided in the support bracket. The size of the support bracket in the longitudinal direction of the feeder corresponds with the outer diameter of the bushings, while in a direction perpendicular to the longitudinal direction it is larger than the diameter.

The actuation elements for setting the opening width between the two bars consist of control handles with threaded shafts, which are screwed into the bores with respective axes provided in the frontal wall of the support bracket. The threaded shafts push the bushings supporting the outer bar against the action of the springs which are fitted in bores connected to the bores wherein the bushings are located.

In order to set the position of the bushings in the pertaining slots, handles or blocking levers are provided over the support bracket, each of them having a respective threaded pin which is screwed in the upper part of the bore of one of the bushings. In this construction, the precise setting of the position of the outer bar is not easily achieved. For this purpose it is specifically required to first actuate the handles or blocking levers of the outer bar. With the assistance of handles whose threaded shafts are screwed into the bores provided in the frontal wall of the support bracket, the outer movable bar can subsequently be adjusted with respect to the stationary bar, in order to change the distance, as well as the inclination, whereby the adjustments to the thickness of the stocking texture and the introduction in the feeder are facilitated.

The result of this adjustment is normally checked with a thickness gauge. However, when the position of the outer bar is fixed after the adjustment, the set size is subject to changes, which, even if minor, require repeated operations of the above-mentioned kind in order to reach a precise setting necessary in the case of fine hosiery.

OBJECTS OF THE INVENTION

It is the object of the invention to provide a feeder which does not have these disadvantage of the known structures. Still another object is to provide the feeder in which the adjustment of the position of the outer bar with; respect to the inner bar is provided quickly, but still with a high degree of precision.

SUMMARY OF THE INVENTION

According to the invention the feeder is provided with bars for the guidance of the stockings mounted underneath a horizontal support bracket fastened to a vertical wall connected to the looping machine, the inner bar is stationary, while the other bar, lying in the same plane with the inner bar, is fastened to a mechanism subjected to the action of spring members, so that the mechanism can be displaced towards the vertical wall and away from it due to the actuation elements mounted in front of the frontal wall of the support bracket and supported thereon, the outer bar adjusted with respect to the inner bar is slidably supported by the ends of two cylindrical rods in the bores, whose parallel axes lie in the same horizontal plane and run perpendicularly to the vertical wall, the rods project from the bores and are loaded by pressure springs which push the rods in the direction out of the bores, and the adjustment of the mechanism supporting the outer bar takes place by acting upon a single actuation element.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
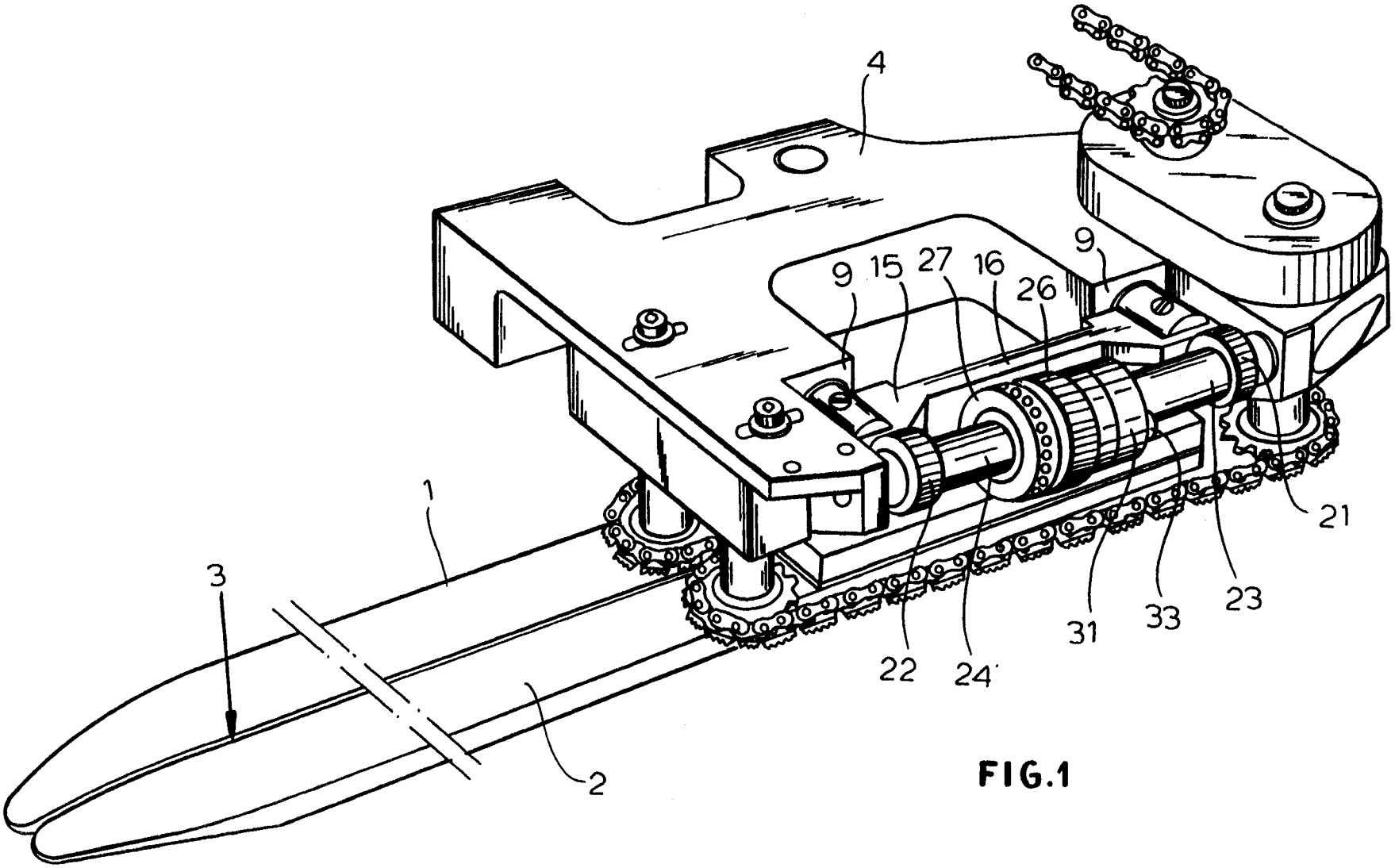
FIG. 1 is a perspective view of a feeder according to the invention.
Figure 2:
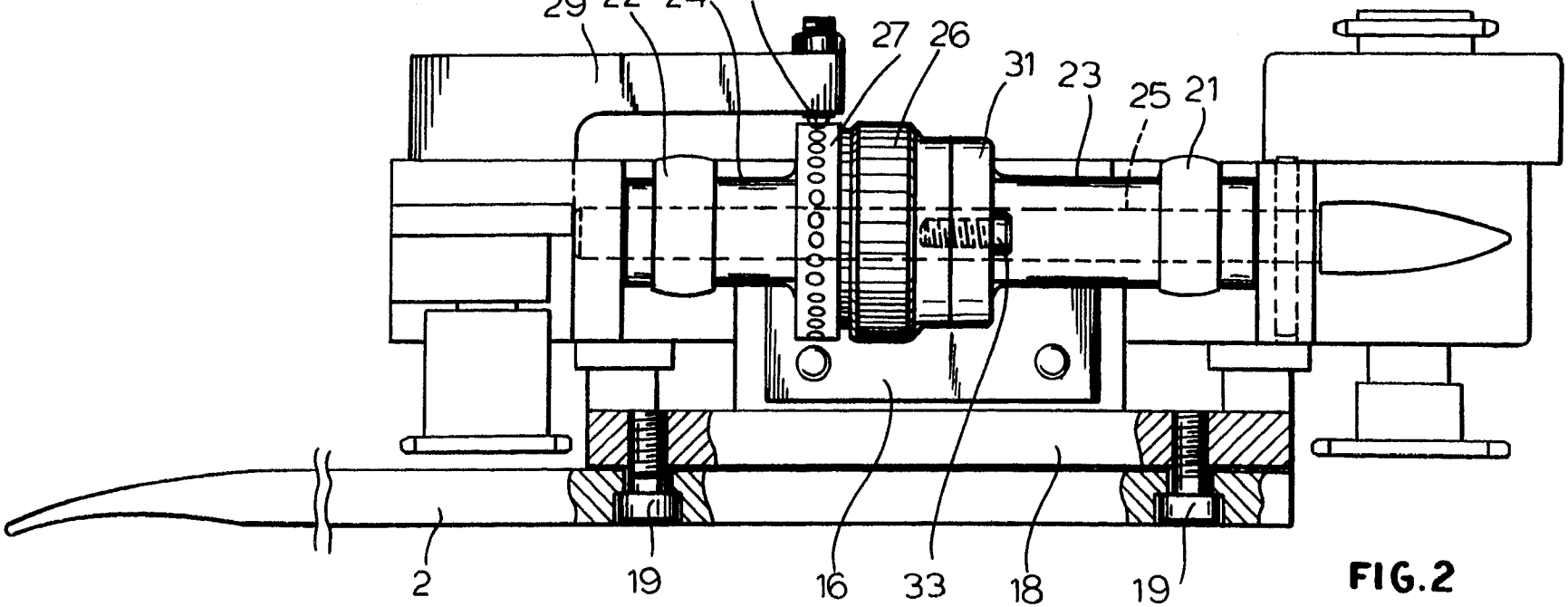
FIG. 2 is a view of the feeder on the side of the outer, movable bar.
Figure 3:
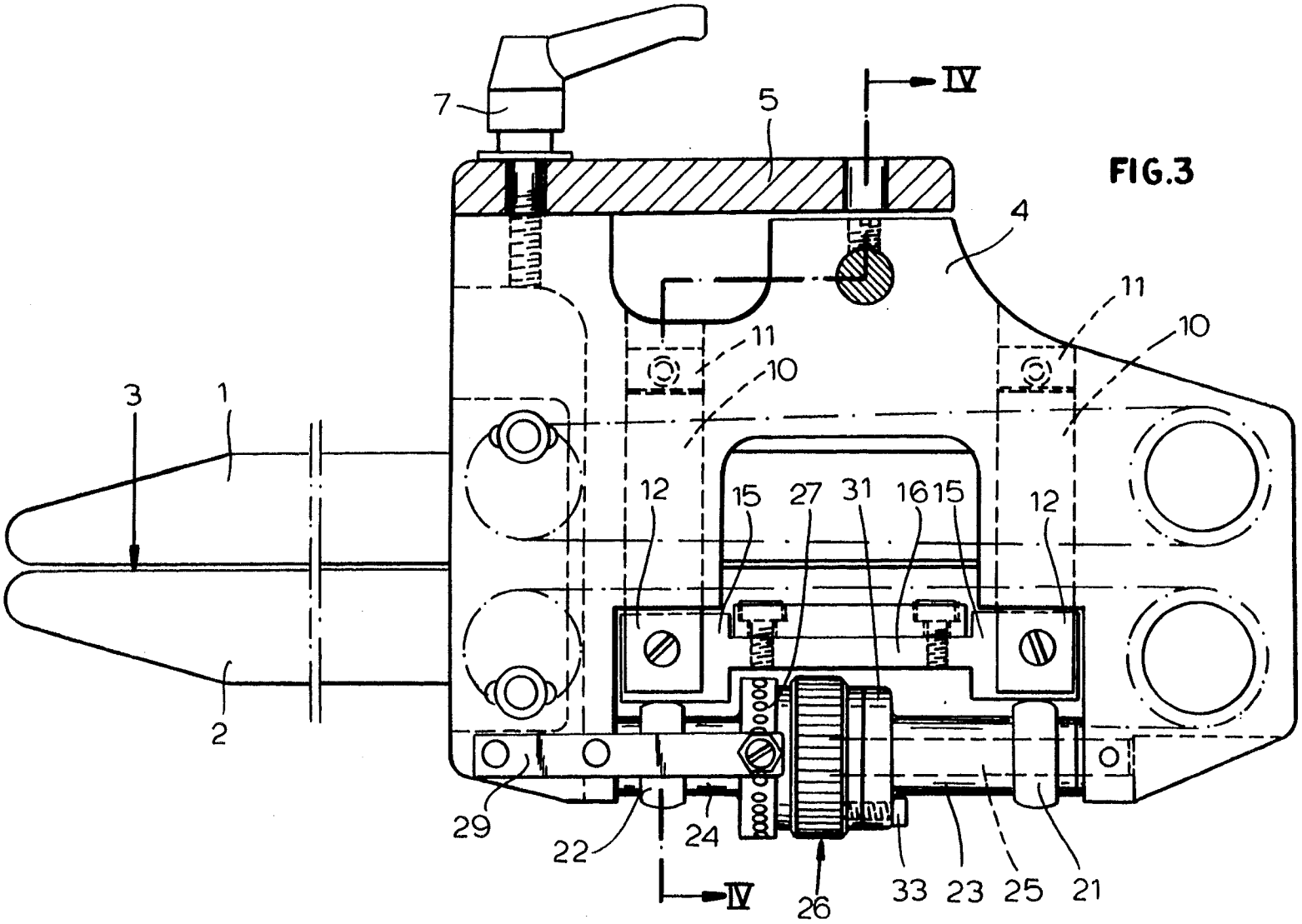
FIG. 3 is a partially sectional top view of the feeder.

The feeder shown in FIG. 1 has two bars or rods 1 and 2 for guiding the stocking. With their edges facing each other, the bars form a longitudinal slot 3 delimited by the facing edges and are arranged underneath a support bracket 4 mounted on a vertical wall 5 seen in FIGS. 3 and 4. The wall 5 is connected with a looping machine not shown in the drawing, on which the feeder is mounted. The vertical position of the support bracket 4 can be changed by means of a set screw 6 (FIG. 4), after which the set position is blocked by a locking screw 7 (FIG. 3).

Figure 4:
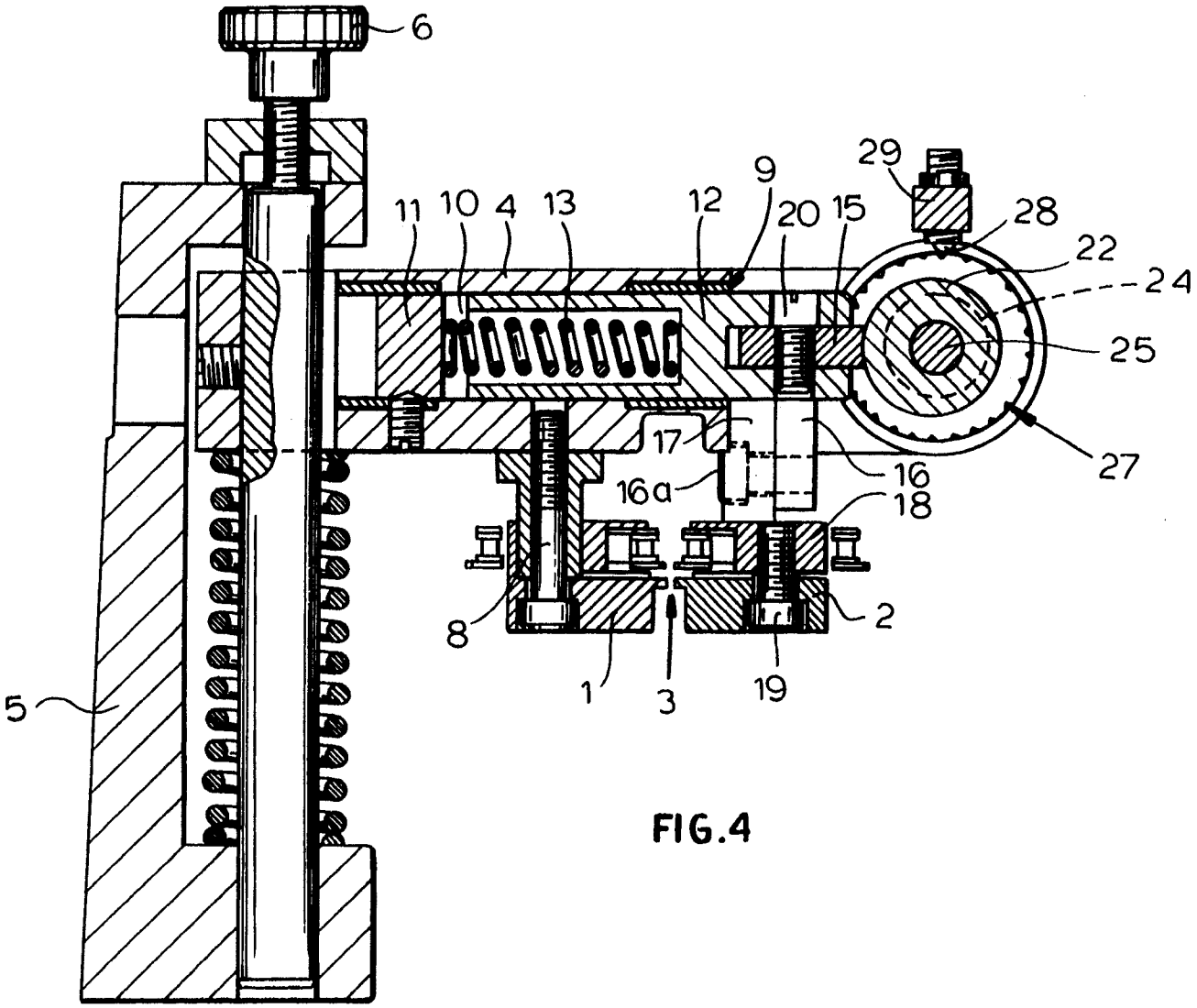
FIG. 4 is a sectional elevational view in the plane IV—IV of FIG. 3.

The bar 1 which is located closer to the vertical wall 5 is designated as the inner bar. As shown in FIG. 4, the inner bar 1 is fastened to the support bracket 4 by screws 8 in two points which are spaced apart in the longitudinal direction of bar 1, so that the bar 1 assumes a stationary position with respect to the support bracket 4.

The other bar 2 which is at a larger distance from the wall 5 is designated as the outer bar 2. It lies in the same plane as the inner bar 1 and is supported on support bracket 4 in such a way that it can be moved with respect thereto, as well as with respect to the inner bar 1, whereby the width of the longitudinal slot 3 between the mutually facing edges of bars 1 and 2 becomes adjustable.

For this purpose in the frontal wall 9 of the support bracket 4 two throughgoing bores 10 (FIG. 3) are provided, which if seen in the longitudinal direction of bars 1 and 2 are mutually spaced apart. The two bores 10 have identical circular cross sections and according to FIG. 4 are closed by plugs 11 at their ends facing the frontal wall 9. In the bores 10 two identically shaped rods 12 are slidably supported, their length being selected so that they project beyond the frontal wall 9 of the support bracket 4.

Each rod 12 has an inner recess, between whose bottom and the respective plug 11 closing the rod opening a pressure coil spring 13 is inserted, which tends to push the respective rod 12 away from the wall 5.

Figure 5:
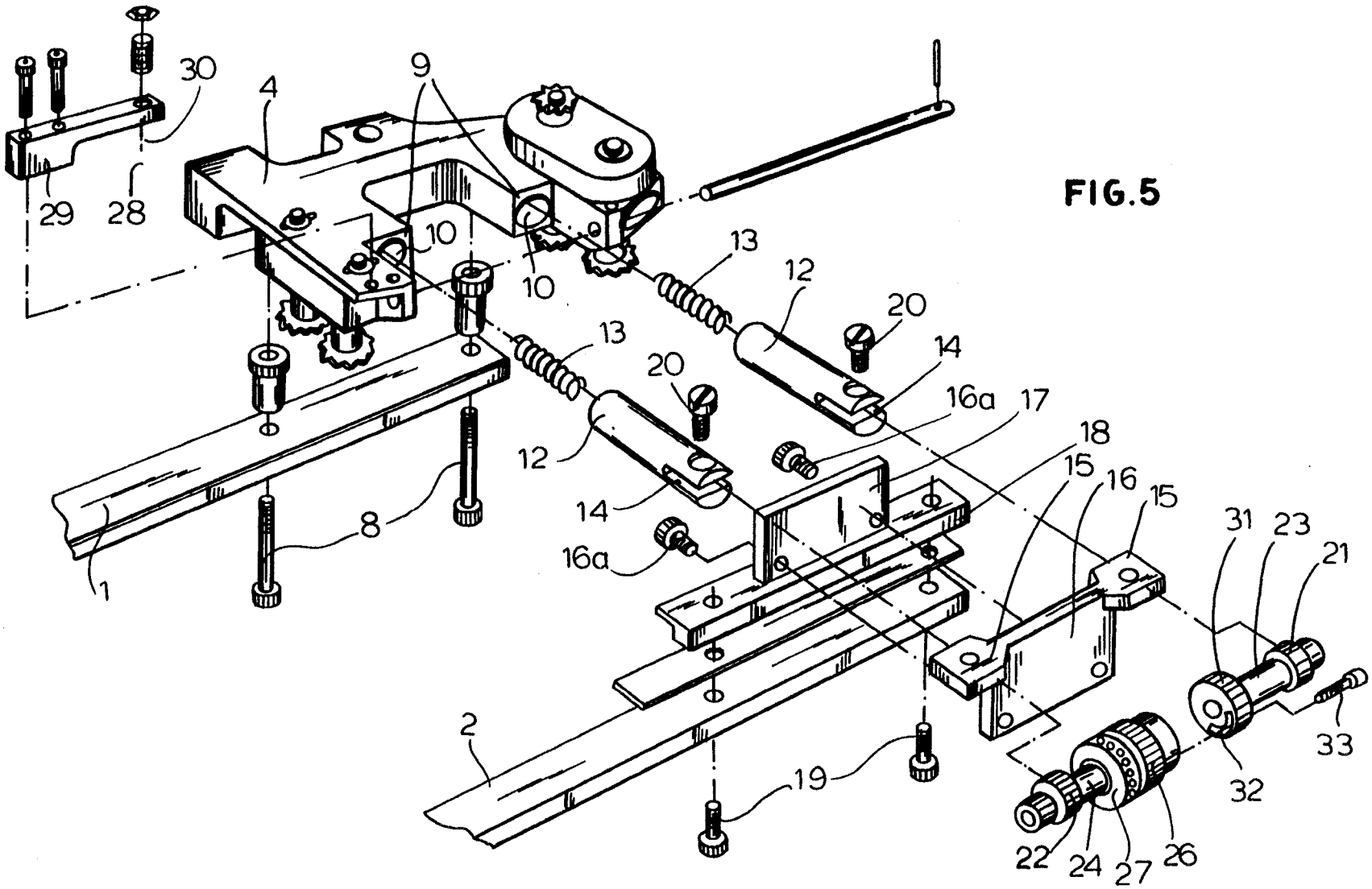
FIG. 5 is an exploded view of the feeder.

The end segments of rods 12 projecting from the bores 11 beyond the frontal wall 9 of support bracket 4, have diametrically provided slots 14, which are engaged by horizontally arranged perforated heads 15, which, in turn extend laterally from a plate 16. As seen in FIGS. 3 and 5, the plate 18 is fastened with screws 16*a* to a vertical web 17 of a horizontal rail 16, to which the outer, movable bar 2 is fastened with screws 19.

The heads 15 of the vertical plate 16 are fastened via screws 20 to the rods 12. The heads are pushed by rods 12 against the cams 21 and 22 which are mounted on bushings 23, respectively 24. The bushings 23 and 24 are rotatably supported on a pin 25 fastened to the support bracket 4 and running perpendicularly to the axes of bores 10 wherein the rods 12 are lodged.

Figure 6:
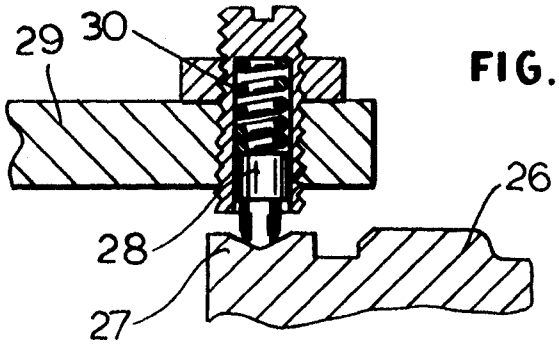
FIG. 6 is an enlarged sectional view of a detail of the feeder.

The bushing 24 has an annular grip 26, on one side of which a dial 27 of evenly spaced holes is provided. In these holes a small arresting element 28 can engage, which is supported by an arm 29 rigidly connected with the support bracket 4 and which can be pressed by a small spring 30 against the circumference of dial 27 as shown in FIG. 6. On the bushing 23 a flange 31 is formed, wherein a curved slot 32 is provided, a screw 33 threaded into the threaded bore provided in the grip 26 running through this slot. This way the two bushings 23 and 24, and with them the cams 21 and 22, can be displaced in circumferential direction relatively to each other, whereby the distance between bars 1 and 2 on the incoming side of the feeder can be increased. This is possible due to the fact that at least one of the two screws 20 are arranged in their location with a little play.

Compared to the state of the art the invention achieves the essential advantage that for the adjustment it is enough to act only upon one actuation member (grip 26), instead of four (two blocking levers and two pivot levers with threaded pins without even achieving this way the desired adjustment accuracy in a simple way).

Beyond the described and illustrated embodiment examples changes are possible within the framework of the invention concept.

Figure 7:
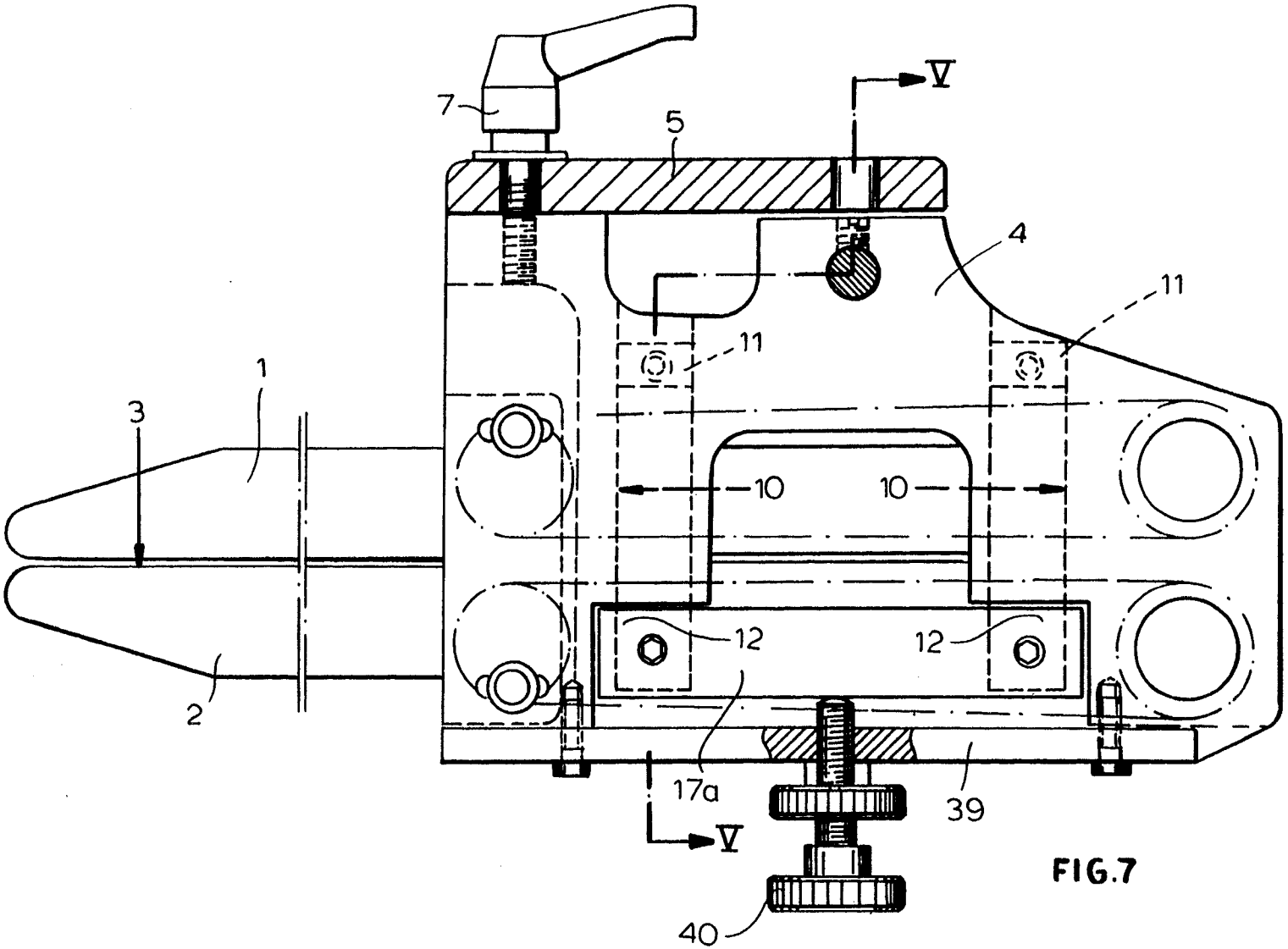
FIG. 7 is an embodiment of the feeder according to the invention having the top view corresponding to the one shown in FIG. 3.
Figure 8:
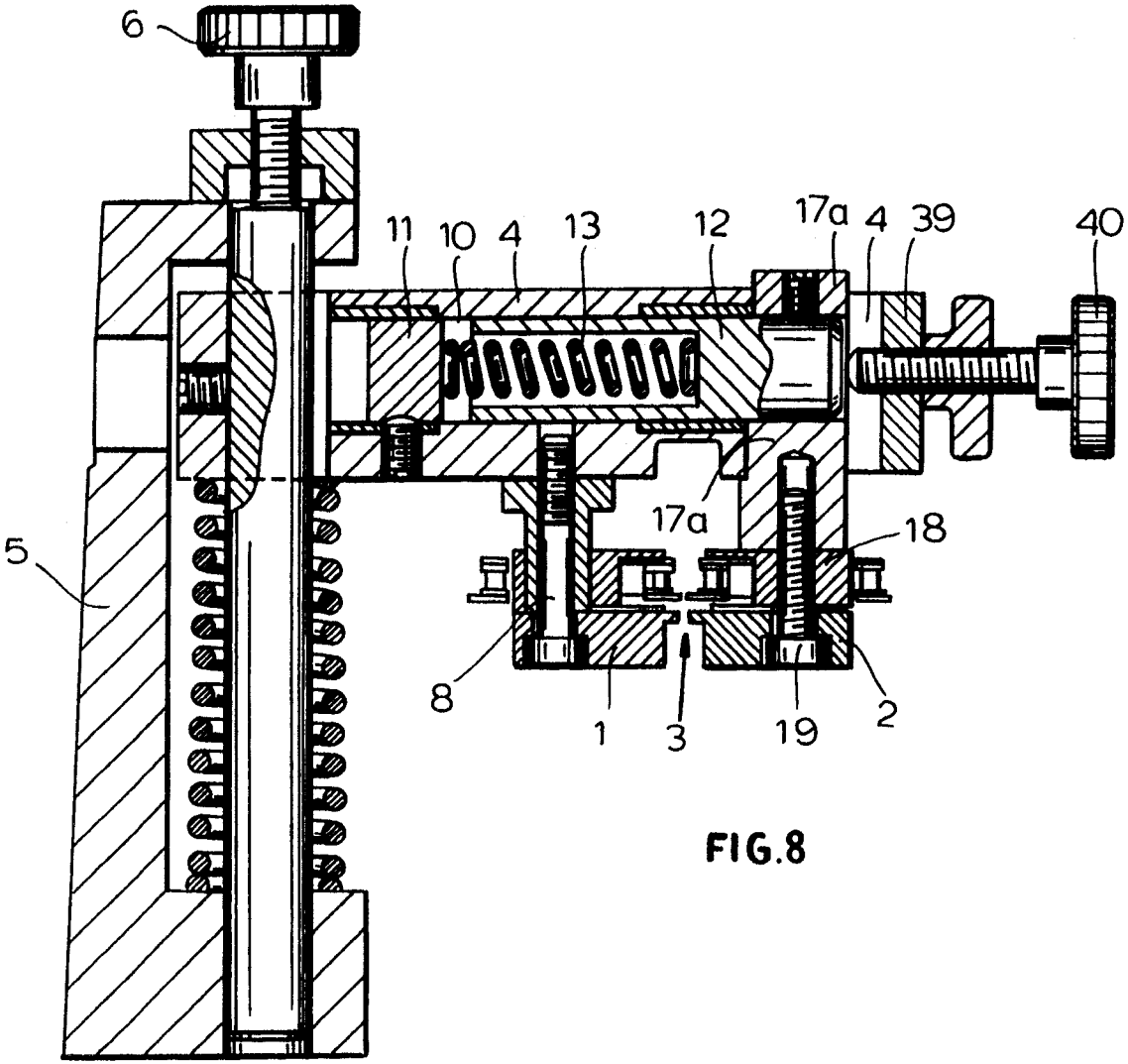
FIG. 8 is an elevational sectional view in the plane V—V of FIG. 7.

So, for instance, as shown in FIGS. 7 and 8, the construction can be further simplified by eliminating the cams 21 and 22 with the pertaining pin 25 and the grip 26 with the notch dial 27, as well as the plate 16, whereby then the U-shaped space of the support bracket 4 is closed by an external plate 39 fastened to the support bracket 4. The web 17*a* which is movable in the U-shaped space is fastened to the ends of rods 12 and is guided by them.

For the displacement of the web 17*a* serves a single pivot handle 40, whose threaded shaft is screwed into a threaded bore provided in the external plate 39. The end of the threaded shaft presses against the movable web 19*a*.

The position of the outer bar 2 with respect to the inner bar 1 can be changed due to the fact that the bores receiving screws 19 have a diameter which is slightly larger than the diameter of screws 19. By manual actuation it becomes possible to set the bar 2 at the correct angle of inclination.

I claim:

1. A feeder for stockings in a looping machine, comprising:

a horizontal support bracket mounted on a vertical wall and having a frontal side facing away from the wall;

inner and outer spaced apart coplanar elongated guide bars mounted underneath the support bracket, the inner bar being mounted fixedly; and adjusting means mounted on the frontal wall for varying a distance between the bars and including:

a pair of spaced apart bores formed in the bracket and opening into the frontal side, the bores extending along respective parallel bore axes extending transversely to the bars toward the vertical wall and perpendicular thereto, respective pair of rods mounted slidably in respective bores and coaxial therewith, each rod having a respective outer end projecting from the respective bore, respective springs in the bores biasing the rods axially outwardly, the outer bar being operatively connected with the rods and displaceable therewith, and actuating means operatively connected with the outer ends of the rods for displacing the outer bar toward and away from the inner bar upon displacing the rods along the bore axes inwardly by overcoming the forces generated by the springs and outwardly upon yielding the forces.

2. The feeder defined in claim 1 wherein the actuating means includes:

a bolt mounted on the frontal wall of the bracket and extending along a bolt axis horizontally perpendicular to the bore axes;

a pair of axially spaced apart bushings mounted rotatably independently the bolt;

respective pair of cams mounted on respective bushings and rotatable therewith, each cam being supported by the respective outer end of the respective rod; and control means for setting an angular position of a grip mounted rotatably on the bolt.

3. The feeder defined in claim 2 wherein the control means includes a dial formed with a plurality of equidistantly angularly spaced apart notch seats on the grip, the feeder further comprising a support operatively connected with the bracket and having a respective outer end juxtaposed with the dial and provided with an arresting pin displaceable toward and away from the dial and bias means for pressing the pin against a respective one of the notch seats of the dial setting thereby a desired angular position of the grip.

4. The feeder defined in claim 2 wherein the actuating means further includes means for angularly displacing the cams with respect to one another.

5. The feeder defined in claim 1 wherein the actuating means includes a threaded shaft displaceable back and forth along the bore axes and a twist grip mounted on a respective outer end of the shaft for displacing the shaft, the frontal side of the support bracket being provided with a displaceable plate acting upon the rods and having a threaded bore receiving an inner end of the shaft.

* * * * *